US009180359B2

(12) United States Patent
Deutsch

(10) Patent No.: US 9,180,359 B2
(45) Date of Patent: Nov. 10, 2015

(54) ROTATABLE BINDING SYSTEM

(71) Applicant: Donough H. Deutsch, Yardley, PA (US)

(72) Inventor: Donough H. Deutsch, Yardley, PA (US)

( * ) Notice: Subject to any disclaimer, the term of this patent is extended or adjusted under 35 U.S.C. 154(b) by 0 days.

(21) Appl. No.: 14/595,411

(22) Filed: Jan. 13, 2015

(65) Prior Publication Data

US 2015/0202523 A1 Jul. 23, 2015

Related U.S. Application Data

(60) Provisional application No. 61/928,454, filed on Jan. 17, 2014.

(51) Int. Cl.

| | |
|---|---|
| ***A63C 5/04*** | (2006.01) |
| ***A63C 10/14*** | (2012.01) |
| ***A63C 5/06*** | (2006.01) |
| ***A63C 10/16*** | (2012.01) |

(52) U.S. Cl.
CPC . *A63C 10/14* (2013.01); *A63C 5/06* (2013.01); *A63C 10/16* (2013.01)

(58) Field of Classification Search
CPC ..... A63C 10/18; A63C 5/06; A63C 10/16
See application file for complete search history.

(56) References Cited

U.S. PATENT DOCUMENTS

| | | | | |
|---|---|---|---|---|
| 5,135,249 | A * | 8/1992 | Morris | 280/609 |
| 5,913,530 | A * | 6/1999 | Berger et al. | 280/607 |
| 6,220,631 | B1 * | 4/2001 | Pritchard et al. | 280/809 |
| 6,579,134 | B1 * | 6/2003 | Fiebing | 440/21 |
| 6,626,443 | B2 * | 9/2003 | Lafond | 280/14.24 |
| 7,090,228 | B2 * | 8/2006 | Reynolds | 280/14.24 |
| 7,500,679 | B2 * | 3/2009 | Wade | 280/28 |
| 2003/0057679 | A1 * | 3/2003 | Pollmiller | 280/611 |
| 2005/0136706 | A1 * | 6/2005 | Yeh | 439/74 |
| 2010/0045000 | A1 * | 2/2010 | Wasserman | 280/605 |
| 2014/0138935 | A1 * | 5/2014 | Sorenson | 280/611 |

* cited by examiner

*Primary Examiner* — John Walters
*Assistant Examiner* — Brian Swenson
(74) *Attorney, Agent, or Firm* — Stuart M. Goldstein

(57) ABSTRACT

A rotatable snowboard binding system allows the front binding to rotate from the riding mode to the skating mode freely, so that a rider can skate and rotate back to the riding mode. When in the skating mode, a fin member protrudes beneath the bottom of the snowboard. This acts on the snow to maintain the rider's direction of travel. The system allows both goofy foot and regular foot riders to safely and easily negotiate lifts and lift lines, and traverse flats by allowing the front binding to rotate between 0° (riding) and 90° (skating) positions. While in the riding mode, bindings and board will function as normal. When the system is utilized in the skating mode, the front binding rotates, allowing the rider to operate the snowboard much like a skateboard. In this rotated position, the fin member protrudes from the bottom of the board.

17 Claims, 9 Drawing Sheets

FIG. 5
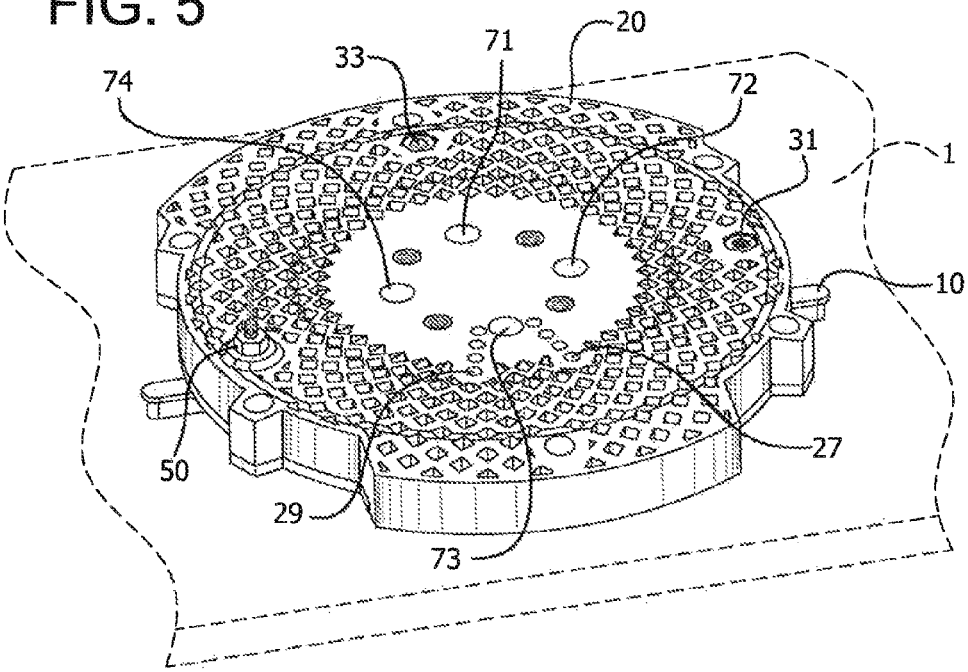
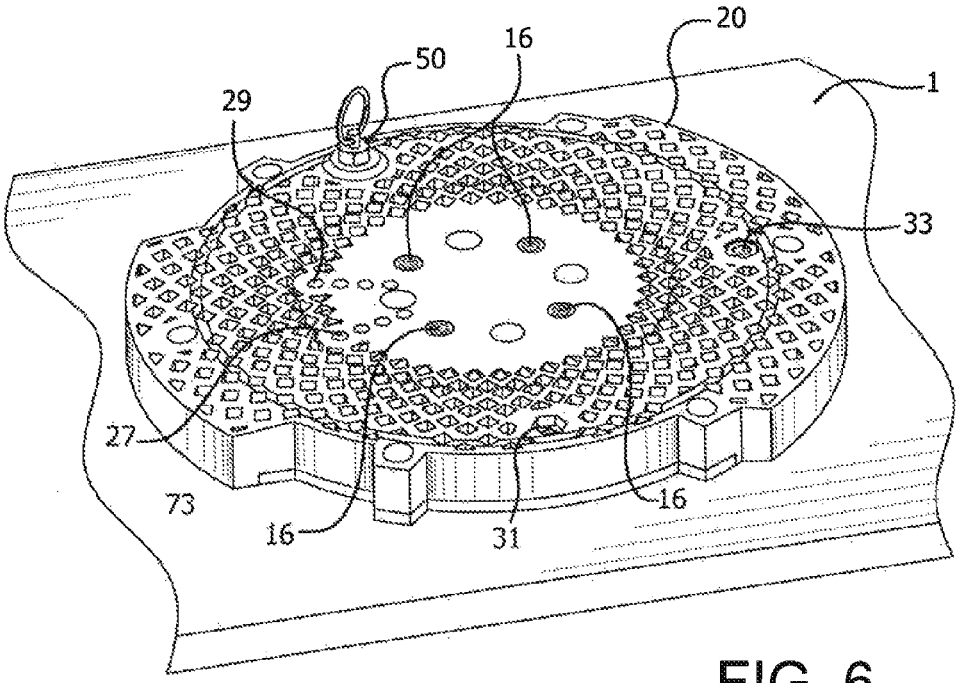
FIG. 6

ROTATABLE BINDING SYSTEM

PRIOR RELATED APPLICATION

This application claims the benefit of application Ser. No. 61/928,454, filed on Jan. 17, 2014.

BACKGROUND OF THE INVENTION

Snowboarding is a winter sport in which riders descend a snowy mountain slope while standing on a specially designed board secured to the rider's feet. The rider's feet are maintained on the board utilizing ski boots secured to special bindings attached to the board. Although modern snowboarding was first practiced in the mid-1960's, its popularity has increased tremendously over the last few years, rivaling snow skiing in the number of its participants.

In riding a snowboard down a slope, the rider's feet are retained in the bindings at an angle generally perpendicular to the longitudinal axis of the board. When the rider is getting on and off chairlifts, or traverses flat areas of the slope, he routinely removes the rear foot from the binding, leaving the front foot attached. He then propels himself by pushing off of the snow with the back foot in the "skating mode", in similar fashion to a skateboarder. While doing this, the front foot remains bound at a perpendicular angle to the rear foot and the rest of his body, thus exerting stress and increasing risk of injury to the front knee, as well as substantial loss of propulsion and control. This presents problems in two main areas of snowboarding: negotiating chairlifts and traversing flats.

While on the chairlift, the rider's hips, knees, and ankles experience added stress, as the board hangs from the front foot and the rider twists his body to ensure that the board hangs underneath and perpendicular to the chair, so as not to impede other riders on the same chair. As the rider embarks or disembarks from the chairlift, he twists his body and front leg so that the board is facing straight forward in the direction of travel of the chair, while keeping his body perpendicular in order to sit. With other riders (particularly a mix of goofy foot riders, i.e. riders with their right foot forward on the board, and regular footed riders, i.e. riders with their left foot forward on the board) and skiers on the same chair also trying to embark/disembark, congestion and the potential for falls is increased. Allowing the rider to remain facing forward while getting on, riding on, and getting off of the chairlift would materially reduce the risk of injury and increase comfort.

When a rider is required to traverse a flat area of the trail and lacks the momentum to complete it without stopping, he has a couple of options. The rider can remove his back foot and "skate" as previously described. Due to the position of the front foot relative to the rest of the body, skating is performed using relatively short strokes with attempts to glide by placing the back foot back onto the board just in front of the rear binding. As a result, propulsive power is rather limited. If the length of the flat terrain is too far or is sloped in such a way that skating takes the rider away from his intended direction of travel, the rider can remove both feet, pick up the board, and walk. Both options require the unnecessary expense of energy, are quite cumbersome and annoying.

Existing snowboard problems are available which attempt, albeit unsuccessfully, to address the problems described above. They all function in basically the same way. The rider must retrofit a rotating plate which is sandwiched between the front binding and the snowboard. By pulling a tether or other release mechanism, the binding is free to rotate forward, then locks in that forward position until released once again to rotate the binding back to the riding mode. There are a number of problems associated with this. A snowboard is controlled using its edges as it moves over the snow. The edges act on the snow by the rider shifting weight between his heel and toe, while feet are in the normal riding mode. Once the front foot is locked into the skating mode, all control of the board is lost. Another problem is that while skating, due to the lack of friction between the snow and bottom of the snowboard, the snowboard tends to drift away from the rider; unlike in skateboarding where the combination of friction and a fixed axis of rotation of the wheels forces the skateboard to move in a specific direction.

SUMMARY OF THE INVENTION

It is thus the object of the present invention to overcome the disadvantages, limitations, inconvenience and risk of injuries resulting from existing snowboards, which all require the user to ride in snowboard riding and skating modes.

These and other objects of the invention are accomplished by an integrated rotatable, snowboard binding system which allows the front binding to rotate from the riding mode to the skating mode freely (without locking), so that a rider can skate and rotate back to the riding mode to glide and maintain control of his board. When in the skating mode, a fin member protrudes approximately one quarter to one half inch beneath the bottom of the snowboard. This acts on the snow to maintain the rider's direction of travel. The system allows both goofy foot and regular foot riders to safely and easily negotiate lifts and lift lines, and traverse flats by allowing the front binding and hence the fin to rotate between 0° (riding) and 90° (skating) positions. While in the riding mode, bindings and board will function as normal. When the system is utilized in the skating mode, the front binding rotates, allowing the rider to operate the snowboard much like a skateboard. In this rotated position, the fin member protrudes from the bottom of the board under the binding rotation system/front binding. The fin member not only assists the rider to maintain a line, but also prevents the board from sliding away from the rider.

The present invention provides the following additional advantages as well:

- Allows for free rotation between 0° (riding) and 90° (skating) in unlocked position.
- Can be configured for use by goofy (right foot forward), and regular (left foot forward) riders.
- The design will maintain as low a profile as possible to minimize binding elevation (ideally 1" or less).
- Locked or riding position will allow maximum transfer of energy from binding to board.
- While released, the binding will rotate with relatively easy force while maintaining stability in heel to toe edge maneuvering, without compromising energy transfer from binding to board.
- The manual release mechanism is convenient and easy to use.
- Rotation locking system will have two release modes;
  - a) Temporary release: when engaged, the binding is free to rotate from the riding mode to the skating mode. When the binding rotates back to the riding mode, it automatically locks.
  - b) Full release: when released, the binding is free to rotate in all positions and will not lock until temporary mode is engaged.
- The binding will only lock in the riding mode.
- Rotation system will only rotate between 0° and 90°. The binding will not over-rotate.

Rotation system and fin will be constructed of non-corrosive metal for high-strength and environmental tolerances.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

BRIEF DESCRIPTION OF THE DRAWINGS

FIG. 5 shows the binding support of the rotatable binding system of the present invention mounted on a snowboard in the riding position mode.

FIG. 6 shows the binding support of the rotatable binding system of the present invention mounted on a snowboard in the skating position mode.

DETAILED DESCRIPTION OF THE INVENTION

Figure 1:
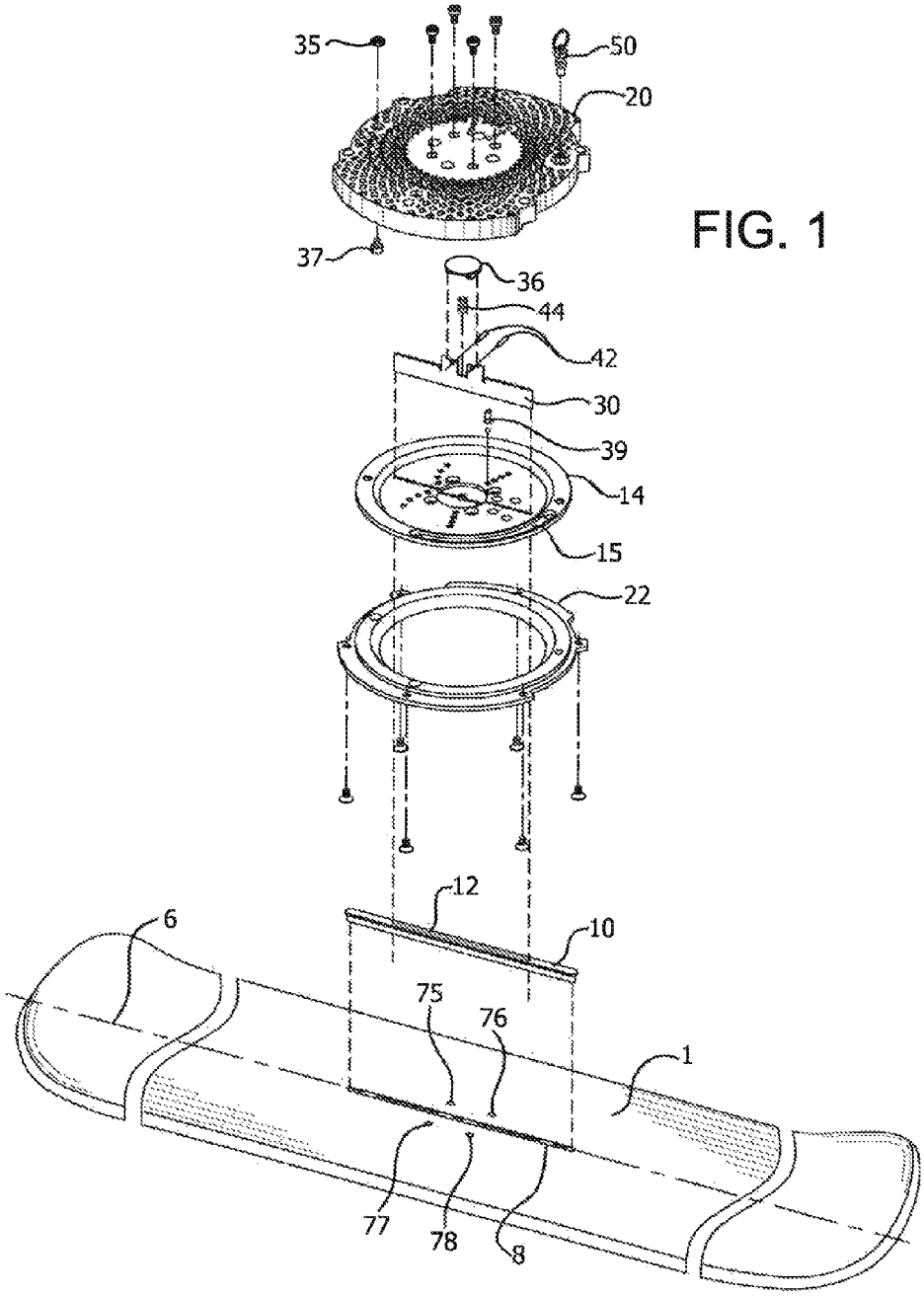
FIG. 1 shows an exploded view of the components of the rotatable binding system of the present invention.
Figure 2:
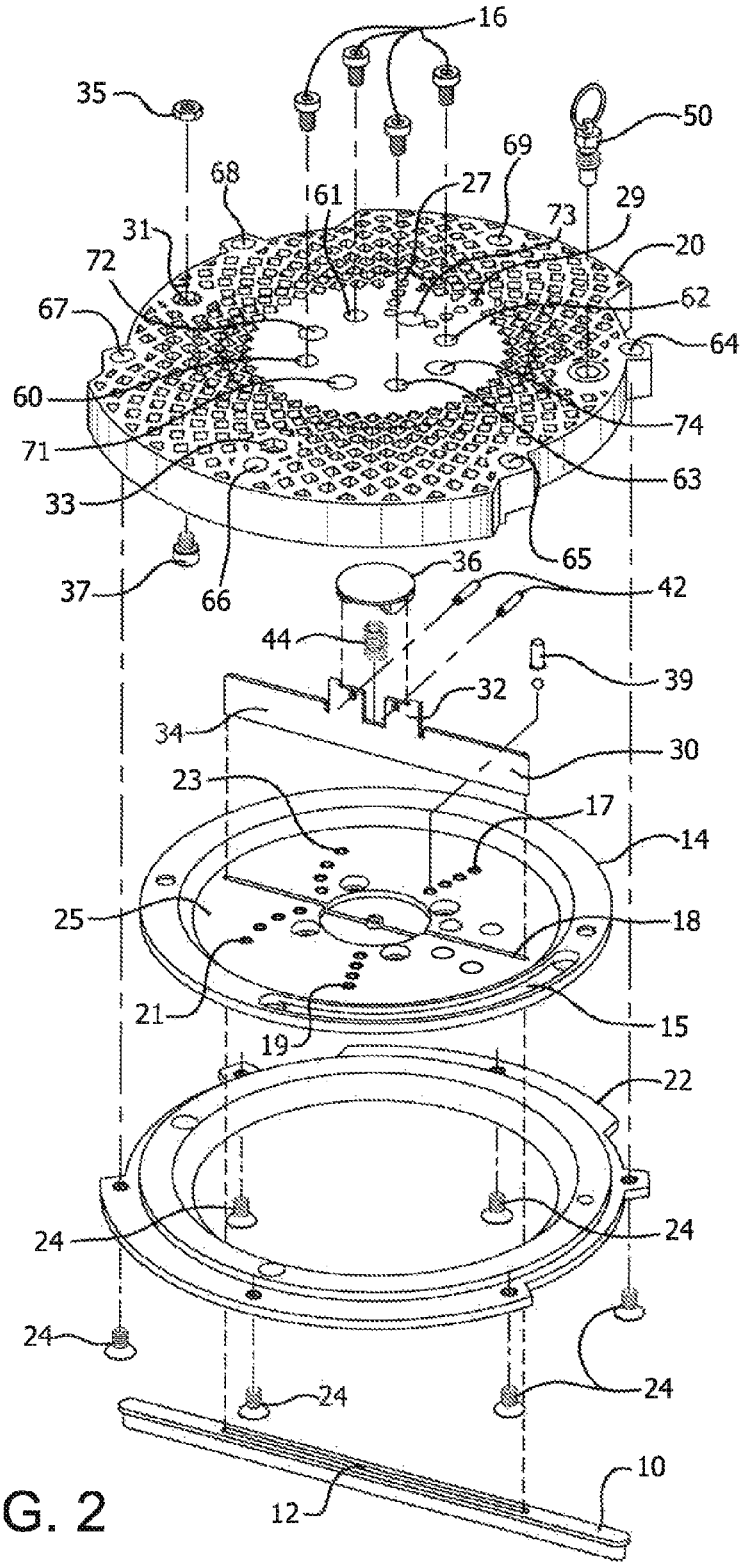
FIG. 2 shows a close-up exploded view of the components of the rotatable binding system of the present invention.
Figure 3:
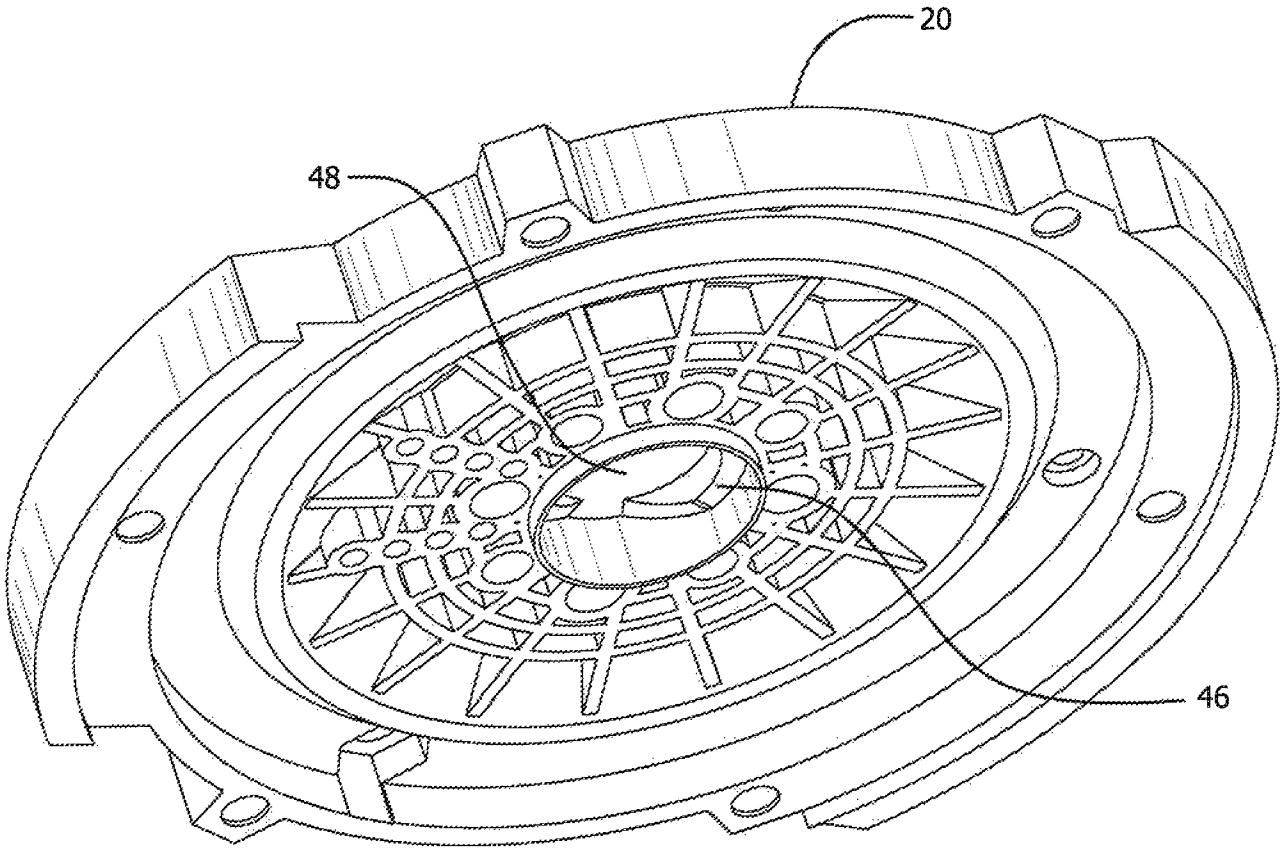
FIG. 3 shows a bottom isometric view of the top plate of the rotatable binding system of the present invention.
Figure 4:
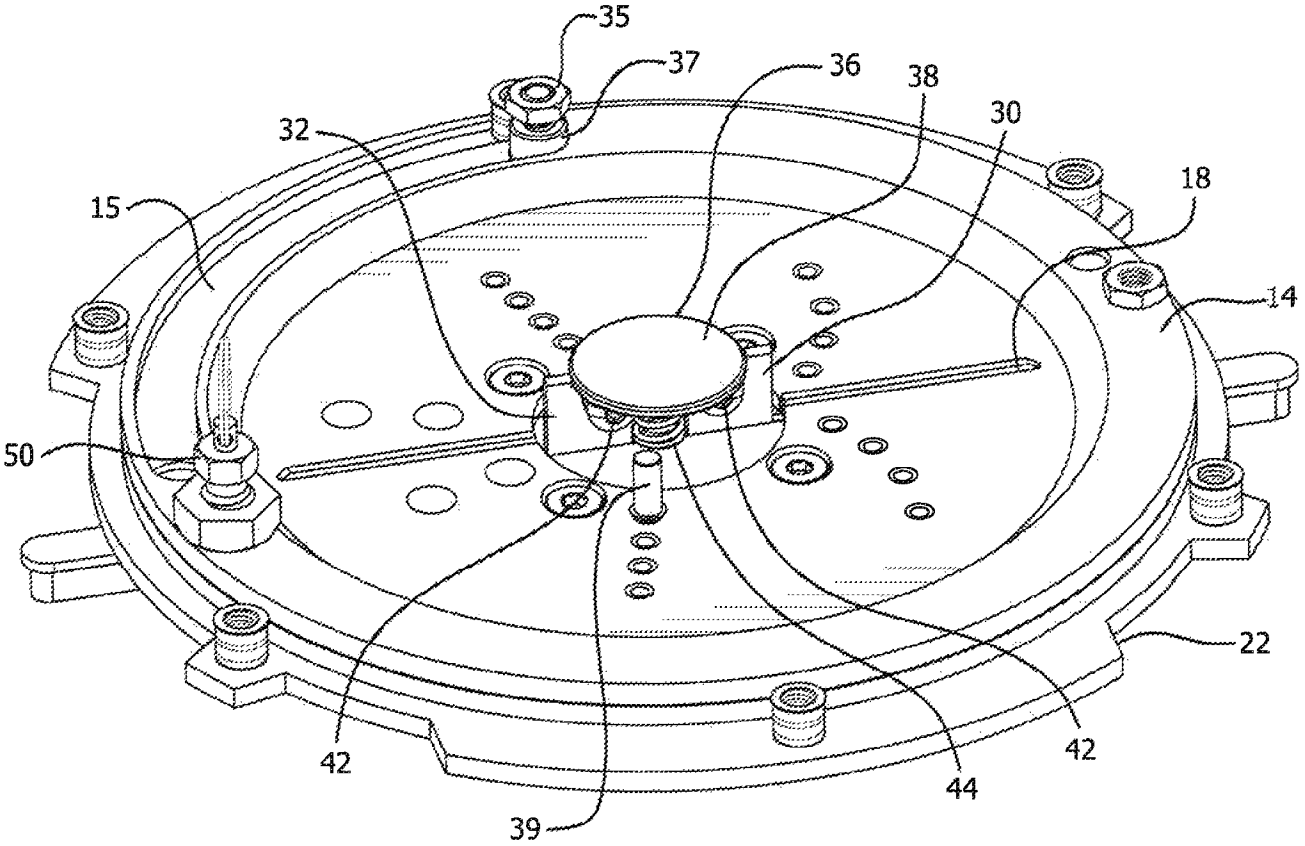
FIG. 4 shows the assembled base plate and bottom ring plate of the rotatable binding system of the present invention.
Figure 7:
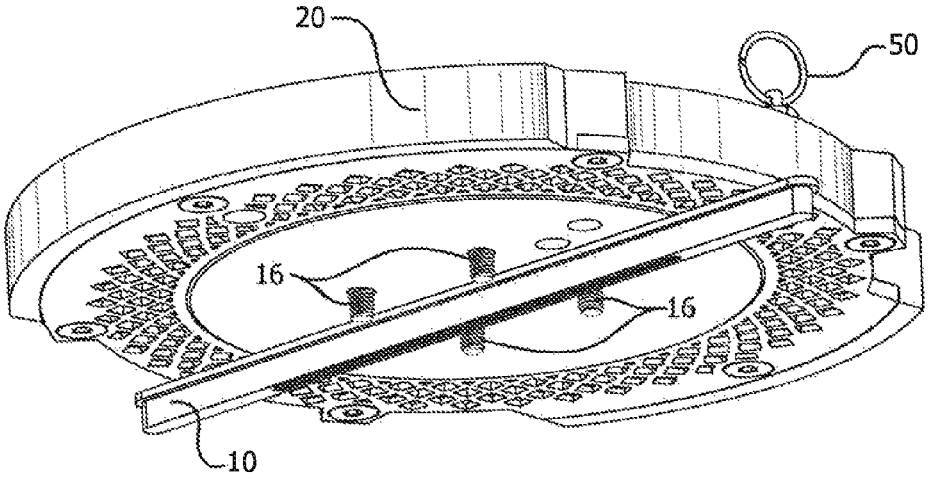
FIG. 7 is an isometric bottom view of the binding support of the rotatable binding system of the present invention, showing the relationship of the fin position bushing which houses the fin member.
Figure 8:
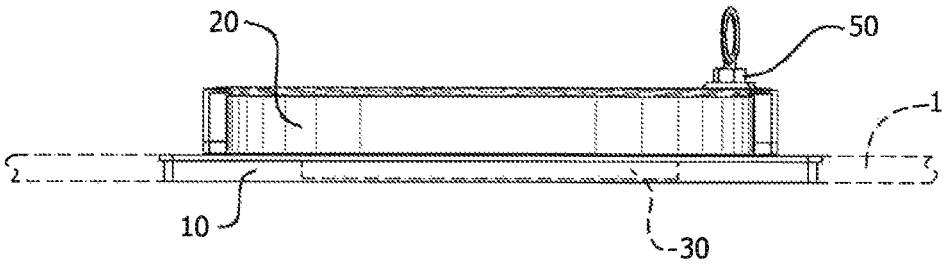
FIG. 8 is an elevation view showing the binding support of the rotatable binding system of the present invention as it would be mounted on a snowboard.
Figure 9:
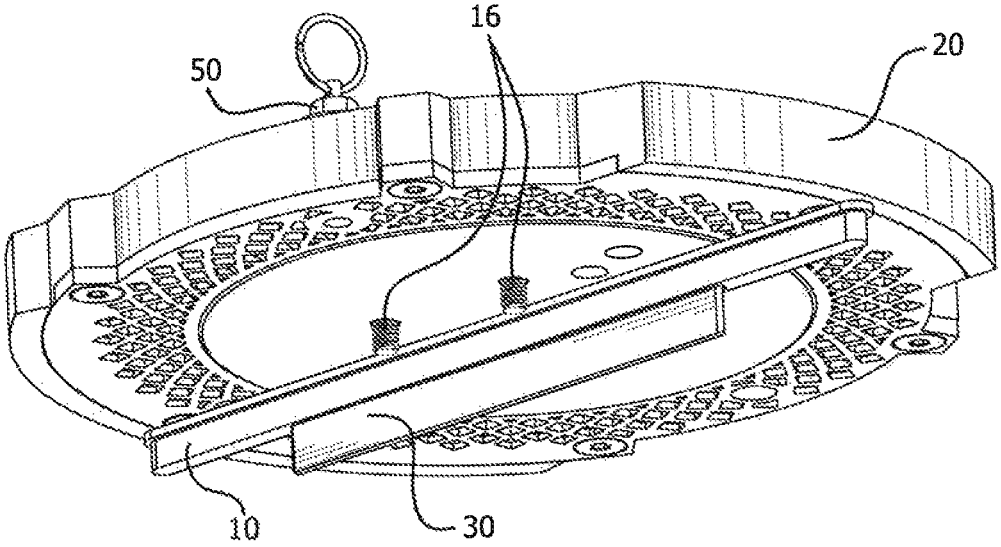
FIG. 9 is an isometric bottom view of the binding support of the rotatable binding system of the present invention, showing the relationship of the fin bushing and the extended fin member.
Figure 10:
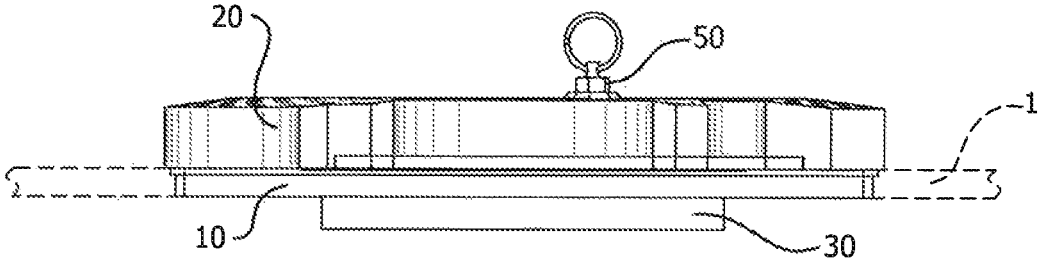
FIG. 10 is an elevation view showing the binding support of the rotatable binding system of the present invention as it would be mounted on a snowboard with its fin member extended.

Snowboard 1 comprises top surface 2, bottom surface 4, and longitudinal axis 6 with slotted board opening 8. Opening 8 is configured to receive fin position bushing 10 with bushing slot 12. Rotatable binding support 13 comprises base plate 14, top plate 20, and bottom ring plate 22 and their connecting components.

Base plate 14 is secured to top surface 2 of snowboard 1 by screws 16 threadably engaged in openings 75, 76, 77, and 78 in the snowboard. Base plate 14 is secured such that slot 18 of the base plate is positioned directly over bushing slot 12 and slotted board opening 8. Access to screws 16 is gained by means of openings 60, 61, 62, and 63 extending through top plate 20. Base plate 14 has accurate channel 15 extending partially around its outer circumference and four sets 17, 19, 21, and 23 of four through openings extending through main body section 25 of the base plate.

Base plate 14 is positioned between top plate 20 and bottom ring plate 22, with the top plate and bottom ring plate being connected by screws 24 extending through six openings in the bottom ring plate and into six threaded openings 64, 65, 66, 67, 68, and 69 in the top plate. When screws 24 are fully threaded within openings 64-69, binding support 13, comprising base plate 14, top plate 20 and bottom ring plate 22, comprises a self-contained unit, secured to snowboard 1 by screws 16. Front foot binding 100 is then attached to top plate 14 of binding support 13 by means of screws 70 through threaded openings 71, 72, 73, and 74 in the top plate. Rear foot binding 102 remains secured directly to snowboard 1.

It is noted that snowboard openings 75, 76, 77, and 78, into which screws 16 extend to attach binding support 13 to snowboard 1, are the same openings into which screws 70 are engaged to normally allow attachment of binding 100 directly to the snowboard. Thus, binding support 13 can efficiently and effectively be used on existing snowboards.

Top plate 20 has two sets 27 and 29 of four through openings and outer hexagonal openings 31 and 33. Footing position selector nut 35 and screw 37 are located within arcuate channel 15 of base plate 14 and inserted and secured in one of the hexagonal holes 31 and 33, based on the preferred footedness of the rider. Hexagonal hole 31 is utilized to position and secure binding support 13 to snowboard 1 for goofy foot riding and hexagonal hole 33 is utilized to position and secure binding support 13 to snowboard 1 for regular foot riding. Ball nose plunger 39 is positioned within one of the eight holes in set openings 27 or 29 of top plate 20, and through one of the holes in set openings 17, 19, 21 and 23 in base plate 14, in order to adjust stance angle.

An alternate means for adjusting the stance angle of the system would be to provide additional outer hexagonal openings, identical to openings 31 and 33, spaced apart in increments of 15° and 30° from each of the openings 31 and 33. This would permit top plate 20 to be mounted over base plate 14, based on the preference of the rider, at any of six positions and thus six stance angles, three for goofy foot riders and three for regular foot riders.

The unique configuration of the invention allows top plate 20 and bottom ring plate 22 being free to rotate in tandem, through the length of accurate channel 15, around base plate 14, which is fixedly mounted to snowboard 1. Due to the positions of selector nut 35 and screw 37 within accurate channel 15 and ball nose plunger 39 set to the desired stance angle within the selected top plate and base plate holes, binding support 13 will not over rotate past the centerline of snowboard 1.

Top plate 20 and bottom ring plate 22 comprise the means for rotatably moving fin member 30 in relation to top surface 2 and bottom surface 4 of snowboard 1. Fin member 30 comprises upper section 32 and lower section 34. Fin cap 36 has curved outer surface 38 and lower section 40. It is fixedly secured to fin member 30 by pins 42 extending between lower sections 34 and 40. Compression spring 44 is positioned below fin cap 36, with fin member 30.

Recess 46 is centrally located at the bottom of top plate 20. Top surface 48 of recess 46 is beveled or angled in relation to the parallel top and bottom surfaces of top plate 20. Fin cap 36 is sized to fit within recess 46. Angled recess 46 of top plate 20, fin cap 36 within the recess, and spring 44 comprise fin adjustment means for movement of fin member 30 in relation to snowboard 1.

Figure 11:
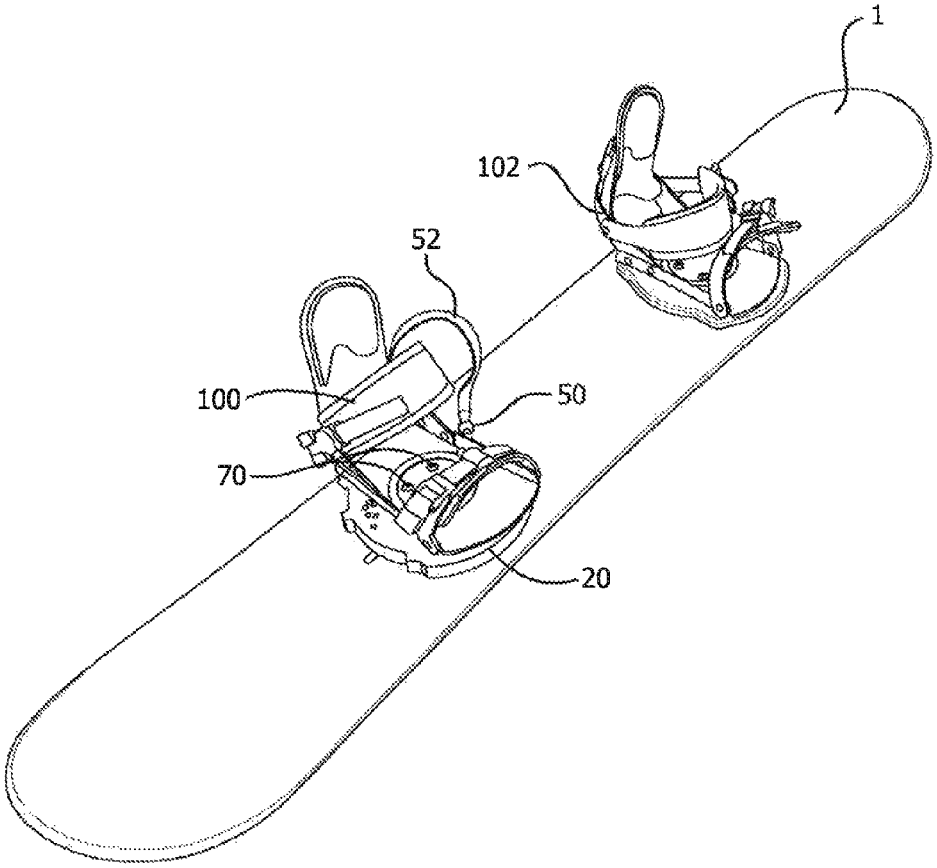
FIG. 11 shows a snowboard utilizing the rotatable binding system of the present invention in the riding position mode.

Binding support lock means in the form of locking spring plunger 50 extends between top plate 20 and bottom ring plate 22. Lanyard 52 extends and is connected between spring plunger 50 and binding 100. When snowboard 1 is in the riding mode, seen in FIGS. 5 and 11, locking spring plunger 50 is set such that the system is locked, i.e. top plate 20, base plate 14, and bottom ring plate 22 are fixedly connected such that fin cap 36 is located within recess 46 of top plate and substantially the entire upper section 32 of fin member 30 is located between top plate 20 and base plate 14. In this position, lower section 34 of fin member 30 remains within base plate slot 18, bushing slot 12, and slotted board opening 8 within longitudinal axis 6 of snowboard 1. Fin member 30 remains within bushing 10 of snowboard 1. This minimizes resistance to the movement of the snowboard over the snow in the riding mode.

Figure 12:
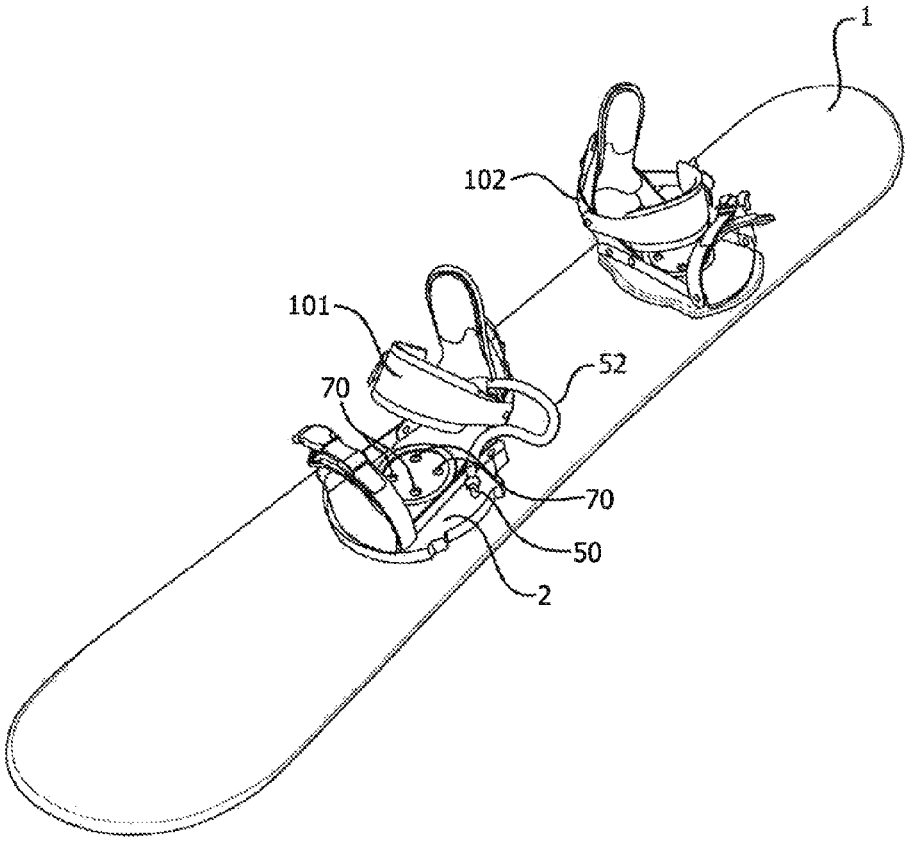
FIG. 12 shows a snowboard utilizing the rotatable binding system of the present invention in the skating position mode.

To rotate binding support 13 to the skating mode, locking spring plunger 50 is pulled upward. This allows 90° rotation of top plate 20 and ring plate 22. See FIGS. 6 and 12. When top plate 20 and bottom ring plate 22 are rotated to the skating mode, curved outer surface 38 of fin cap 36, rotating in relation to beveled top surface 48 of recess 46, converts this rotational force into linear movement. This results in fin member 30 being compelled straight down through base plate slot 18, bushing slot 12 and slotted board opening 8, to approximately one quarter inch past bottom surface 4 of snowboard 1.

When the rider wishes to return to the riding mode, he or she simply counter-rotates top plate 20 and bottom ring plate 22. Ball nose spring plunger 39 will provide some resistance, in order to initiate the rotation from the skating mode, back to the riding mode. Locking spring plunger 50 will then re-engage, locking the rotation of the binding system. When rotating back to the riding mode, the counter-rotation of top plate 20 and bottom ring 22 releases the compression of spring 44, compelling fin cap 36 upward, rotating and then raising and retracting fin member 30 back into bushing 10 of snowboard 1, to again minimize resistance to movement of the snowboard over snow in the riding mode.

Certain novel features and components of this invention are disclosed in detail in order to make the invention clear in at least one from thereof. However, it is to be clearly understood that the invention as disclosed is not necessarily limited to the exact form and details as disclosed, since it is apparent that various modifications and changes may be made without departing from the spirit of the invention.

The invention claimed is:

1. A rotatable snowboard binding system utilized in snowboard riding and skating modes, said system comprising:

a snowboard having a top surface and a bottom surface and a longitudinally extending axis;

a fin member connected to the snowboard;

a binding support rotatable between a riding mode position in relation to the top surface of the snowboard and a skating mode position in relation to the top surface of the snowboard, whereby when the binding support is in the riding mode position, the fin member is located above the bottom surface of the snowboard, and when the binding support is in the skating mode position, the fin member is lowered to a position beneath the bottom surface of the snowboard; and fin member adjustment means for maintaining the fin member within the longitudinal axis of the snowboard and above the bottom surface of the snowboard when the binding support is in the riding mode, and for lowering the fin member to a position beneath the bottom surface of the snowboard when the snowboard is in the skating mode, said fin member adjustment means comprising a fin cap with a curved outer surface mounted directly to the fin member and a compression spring located beneath the fin cap.

2. The rotatable snowboard binding system as in claim 1 further comprising an open slot located on the longitudinal axis of the snowboard through which the fin member extends when the binding support is used in the skating mode.

3. The rotatable snowboard binding system as in claim 1 wherein the binding support comprises a top plate connected to a bottom ring plate.

4. The rotatable snowboard binding system as in claim 3 further comprising a base plate rigidly mounted to the snowboard and located between the top plate and the bottom ring plate, the top plate, base plate, and bottom ring member comprising a self contained unit.

5. The rotatable snowboard binding system as in claim 4 wherein the base plate comprises a base plate slot in which the fin is located in both the riding and skating modes.

6. The rotatable snowboard binding system as in claim 3 wherein the top plate and bottom ring plate are rotated ninety degrees between the riding mode position and the skating mode position.

7. The rotatable snowboard binding system as in claim 1 wherein the binding support has a beveled recess sized to accept and retain the fin cap within the top plate, whereby rotation of the binding support compels the fin cap downward, compressing the spring, and lowering the fin member beneath the bottom surface of the snowboard.

8. The rotatable snowboard binding system as in claim 7 wherein counter-rotation of the binding support releases spring compression and compels the fin cap upward, raising the fin member and returning it to a position above the bottom surface.

9. The rotatable snowboard binding system as in claim 1 further comprising removeable binding support locking means for rigidly maintaining the binding support in the riding mode position, whereby upon removal of the binding support locking means, the binding support is permitted to rotate to the skating mode position and the fin member is lowered to the position beneath the bottom surface of the snowboard.

10. The rotatable snowboard binding system as in claim 9 wherein the binding support locking means comprises a locking spring plunger.

11. A rotatable snowboard binding system comprising:

a snowboard having a top surface, a bottom surface, and a longitudinally extending axis;

a fin member connected to the snowboard;

a binding support comprising a top plate connected to a bottom ring plate, said binding support being rotatable in relation to the longitudinally extending axis of the snowboard;

an open slot located within the longitudinal axis of the snowboard;

fin member adjustment means for maintaining the fin member within the longitudinal axis of the snowboard and above the bottom surface of the snowboard and, upon rotation of the binding support in relation to the longitudinal axis of the snowboard, for extending the fin member through the slot and beneath the bottom surface of the snowboard, said fin member adjustment means comprising a fin cap with a curved outer surface mounted directly to the fin member and a compression spring located beneath the fin cap.

12. The rotatable snowboard binding system as in claim 11 further comprising a base plate secured to the snowboard and being located between the top plate and bottom ring, the top plate, base plate and bottom ring forming a self-contained unit.

13. The rotatable snowboard binding system as in claim 12 wherein the base plate comprises a base plate slot located over the open slot of the snowboard, whereby rotation of the binding support lowers the fin member through the base plate slot and through the open slot of the snowboard.

14. The rotatable snowboard binding system as in claim 11 further comprising removeable binding support locking means for maintaining the binding support in rigid position on the snowboard, whereby upon removal of the binding support locking means, the binding support is permitted to rotate and the fin member is lowered to the position beneath the bottom surface of the snowboard.

15. The rotatable snowboard binding system as in claim 14 whereby upon removal of the binding support locking means, the binding support is permitted to rotate ninety degrees.

16. The rotatable snowboard binding system as in claim 15 wherein the binding support locking means comprises a locking spring plunger.

17. The rotatable snowboard binding system as in claim 11 wherein the top plate comprises a beveled recess sized to accept and retain the fin cap within the top plate, whereby rotation of the top plate and bottom ring compels the fin cap downward, compressing the spring, and lowering and rotating the fin member beneath the bottom surface of the snowboard.

* * * * *